United States Patent [19]

Segerö

[11] Patent Number: 4,571,464

[45] Date of Patent: Feb. 18, 1986

[54] ELECTRET MICROPHONE

[75] Inventor: Tommy S. Segerö, Tyresö, Sweden

[73] Assignee: Telefonaktiebolaget L M Ericsson, Stockholm, Sweden

[21] Appl. No.: 620,112

[22] Filed: Jun. 13, 1984

[30] Foreign Application Priority Data

Aug. 19, 1983 [SE] Sweden ..... 8304504

[51] Int. Cl.[4] ..... H04K 19/01

[52] U.S. Cl. ..... 179/111 E; 29/592 E

[58] Field of Search ..... 179/111 E, 111 R; 307/400; 29/592 E

[56] References Cited

U.S. PATENT DOCUMENTS 3,895,194 7/1975 Fraim ..... 179/111 E

FOREIGN PATENT DOCUMENTS 55-38735 3/1980 Japan ..... 179/111 E 636816 12/1978 U.S.S.R. ..... 179/111 E

*Primary Examiner*—Gene Z. Rubinson

*Assistant Examiner*—Danita R. Byrd

*Attorney, Agent, or Firm*—Roberts, Spiecens & Cohen

[57] ABSTRACT

An electret microphone comprising a rectangular metal electrode, a metallized electret film and an amplifier element encapsulated in a lower and an upper casing half. A contact element comprises a flat web portion and two prongs which are provided with tubes of electrically conductive silicon rubber. In the assembled microphone, the electret film is retained by the tubes which simultaneously provide electrical contact between the film and the amplifier element.

6 Claims, 4 Drawing Figures

ELECTRET MICROPHONE

FIELD OF THE INVENTION

The present invention relates to an electret microphone and more specifically to an electret microphone with a specially formed contact element between the electret film and the amplifying element in the microphone.

BACKGROUND

An electret microphone of the kind intended here is described, e.g. in the Swedish patent No. 8302197-2. It includes a casing made from a upper and lower casing halves and it contains a metal electrode, a metallized electret film and an amplifying element, which are enclosed and located by the upper and the lower casing halves and their fastenings. The problem is to keep the electret film in place in the microphone with a given clamping force and at a given distance from the rear metallic electrode. In the known electret microphone, this has been solved by placing a spacer washer of insulating material between the film and the rear electrode.

SUMMARY OF THE INVENTION

An object of the present ivention is to provide improved holding of the electret film in an electret microphone of the kind described above, while good contact between the electret film and the contact element included in the microphone is obtained. This is achieved by a fork-like contact element provided with conductive silicon rubber, which provides conductive communication between the electret film and the included amplifier element at the same time as it holds the electret film by the action of friction.

BRIEF DESCRIPTION OF DRAWING

The invention will now be described in detail with reference to the accompanying drawing, in which.

BEST MODES FOR CARRYING OUT THE INVENTION

Figure 1:
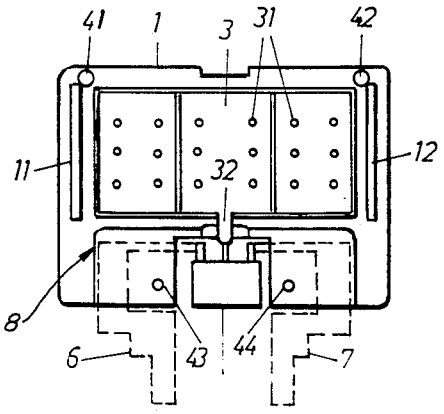
FIG. 1 is a view from above of the lower casing half of an electret microphone in accordance with the invention.

The electret microphone in accordance with the present invention is formed by a casing consisting of upper and lower casing halves, together with included units. FIG. 1 illustrates the lower casing half in the form of a rectangular plate 1. This is formed with two shallow grooves 11, 12, one along each short side and with a rectangular opening covered in FIG. 1 by the rear electrode 3 of the microphone. The electrode 3 is of known construction and is provided with a plurality of holes 31 distributed over three sections. The electrode 3 is furthermore provided with a projecting tongue 32 making electrical contact with one electrode of an integrated amplifier in the form of an IC capsule 8. The capsule 8 has two further electrodes, one contacting a contact tab 6 and the other a contact tab 7, each of which rests against the flat surface in respective recesses in the plate 1. The contact tabs 6, 7 are illustrated in dashed lines.

Pins, 41, 42 and 43, 44 are arranged upstanding and at right angles to the plate 1, these pins engaging in corresponding holes in the upper casing half for keeping together both halves.

Figure 2:
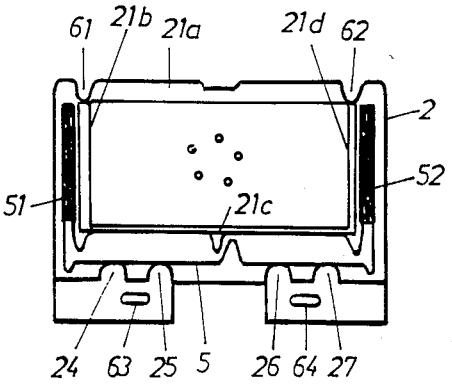
FIG. 2 is a view from below of the upper casing half of the microphone.

FIG. 2 illustrates the upper casing half 2. This is made from a thin plate of approximately the same exterior dimensions as the lower half 1. The casing half 2 is formed with a flat rectangular central portion 22 provided with sound openings in the form of a plurality of holes 23. The dimensions of the central portion 22 are generally in agreement with the dimensions of the opening in the lower half 1, covered by the metallic electrode 3. The central portion 22 is separated from remaining parts of the upper half by protecting edge portions, which thus form narrow longitudinal raised surfaces 21*a*, 21*b*, 21*c* and 21*d*. In the upper casing half there are moreover two rounded cutouts 61, 62 and two holes 63, 64 adapted for engagement with the upstanding pins 41, 42 and 43, 44, respectively, on the lower half 1 so that when assembled both halves are fastened together.

Figure 3:
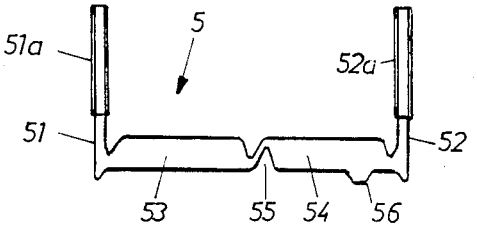
FIG. 3 illustrates the fork-like element included in the microphone according to the invention.

In accordance with the invention there is a connection member 5 in the form of a fork disposed on the upper half 2. The appearance of the fork 5 is apparent from FIG. 3. It comprises web portions 53, 54 and two prongs 51, 52 of metallic material, suitably nickel brass. Both prongs 51, 52 are provided with tubes 51*a*, 52*a* of conductive silicon rubber. In the embodiment illustrated, the middle section of the fork is further formed with a waisted S-shaped portion 55 between the portions 53 and 54 of the web so that these will not be displaced laterally for possible temperature variations in the assembled electret microphone.

When the fork 5 is fitted on the upper casing half 2, the fork is fixed as illustrated in FIG. 2 with the aid of the web portions 53 and 54, which are clamped between the raised surface 21*c* and holding means on the half 2 in the form of clamping abutments 24, 25 and 26, 27 respectively. The silicon rubber tubes 51*a*, 52*a*, will then be situated adjacent to the respective raised surfaces 21*b* and 21*d*.

Figure 4:
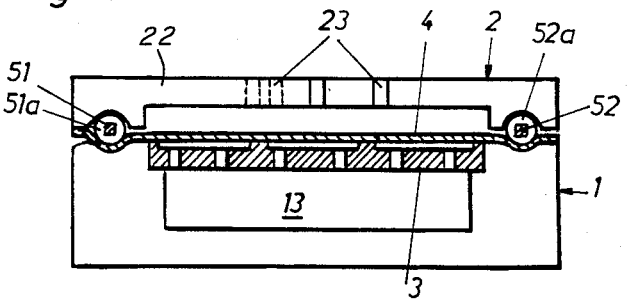
FIG. 4 is a cross-section of an assembled microphone in accordance with the invention.

FIG. 4 is a cross-section of the assembled electret microphone. The electret film 4 is stretched with a given force and is locked in its position by the rubber tubes 51*a*, 52*a* which, are pressed against the film, which in turn, is pressed against the bottoms of both grooves 11, 12 in the lower half 1. The upper half 2 presses, in turn, against the rubber tubes 51*a*, 52*a*, which are thus somewhat deformed by it when it is pressed into its mating position against the lower half 1. The electret film lies along the rear electrode 3 and only touches the ridges illustrated in FIG. 4 which separate the different sections of the electrode 3. A rear chamber of the electret microphone is denoted by 13 in FIG. 4. The pins 41–44 indicated in FIG. 1 are located in the holes 61–64 and are riveted down. The assembled microphone is finally placed in a screening outer casing (not shown).

An advantage with the silicon rubber tubes 51*a*, 52*a* is that the mechanical stress occurring during assembly does not dissipate with time as it would for other plastic materials. A given clamping force against the electret film 4 thus remains during the entire life of the microphone.

The tubes 51*a*, 52*a* are made from silicon rubber, as mentioned above. A high friction between the rubber and the electret film ensures film location of the film which should maintain a mechanical stress of about 60 N/m during its entire lifetime. If the clamping force should decrease, there is the risk that the electrostatic force in the air gap would pull the film towards the electrode 3, resulting in collapse whereby the electrical output level from the microphone would be reduced.

The electret film consists, for example, of polarized Teflon ® with a metallic coating. The electrical contact is obtained between the metallic coating and each rubber tube on the prongs of the fork. The middle portion 54 of the fork is provided with a tongue 56 which engages against one contact tab 7 (grounded to the outer casing of the microphone) when the microphone is assembled and thus provides electrical contact with one of the electrodes of the amplifier 8. The other contact tab 6 of the integrated amplifier is the signal output, while the signal input is the electrode on the amplifier 8 which is connected to the tongue 32 of the rear electrode 3. Contact is thus made inside the casing without any extraneous wiring.

The electrical resistance between one of the prongs 51 or 52 of the fork 5 and the metal coating of the electret 4 via the rubber tube is about 50 ohms. This resistance is coupled in series to the capacitance of about 10 pF between the electrode and the metal coating of the electret film. The value of 50 ohms is negligible compared with the high-impedance input side (at the tongue 32) of the integrated circuit.

What is claimed is:

1. An electret microphone comprising a casing including upper and lower casing halves, a rectangular metal electrode in said casing, said rectangular metal electrode having long and short sides, a metallized electret film which substantially covers the metal electrode, an amplifier element in the form of an integrated circuit capsule with a plurality of contact pins, a U-shaped contact element including a flat web portion and two prongs provided with elastic and electrically conductive material, wherein said prongs extend along the short sides of the rectangular metal electrode such that the electret film is retained by friction with said elastic material.

2. An electret microphone as claimed in claim 1 wherein said elastic and electrically conductive material are in the form of tubes.

3. An electret microphone as claimed in claim 2 wherein said tubes are made from silicon rubber.

4. An electret microphone as claimed in claim 3 wherein one of said casing halves has grooves in which the electret film is pressed by said tubes between said halves.

5. An electret microphone as claimed in claim 4 wherein said halves include respective interengaged pins and openings.

6. An electret microphone as claimed in claim 1 wherein said flat web portion includes an intermediate S-shaped portion.

* * * * *